United States Patent [19]

Muschner

[11] Patent Number: 4,801,055

[45] **Date of Patent: * Jan. 31, 1989**

[54] METHOD OF REPAIRING OR RENEWING A WORN REFRACTORY PLATE OF A SLIDING CLOSURE UNIT

[75] Inventor: Udo Muschner, Tönisvorst, Fed. Rep. of Germany

[73] Assignee: Didier-Werke AG, Wiesbaden, Fed. Rep. of Germany

[ * ] Notice: The portion of the term of this patent subsequent to Oct. 27, 2004 has been disclaimed.

[21] Appl. No.: 890,481

[22] Filed: Jul. 29, 1986

Related U.S. Application Data

[63] Continuation-in-part of Ser. No. 893,447, Aug. 7, 1986, Pat. No. 4,702,460, which is a continuation of Ser. No. 678,033, Dec. 14, 1984, abandoned.

[30] Foreign Application Priority Data

Dec. 16, 1983 [DE] Fed. Rep. of Germany ..... 3345539
Aug. 2, 1985 [DE] Fed. Rep. of Germany ..... 3527756

[51] Int. Cl.[4] ..... B22D 41/08

[52] U.S. Cl. ..... 222/590; 222/600; 266/236; 29/402.11

[58] Field of Search ..... 222/600, 598, 590, 591; 266/271, 272; 164/488, 437, 337; 29/402.11, 402.13, 402.16, 402.18

[56] References Cited

U.S. PATENT DOCUMENTS

| | | | |
|---|---|---|---|
| 4,434,540 | 3/1984 | Cappelli | 29/402.11 |
| 4,445,262 | 5/1984 | Cappelli | 222/600 X |
| 4,546,815 | 10/1985 | Liebermann et al. | 164/488 X |
| 4,702,460 | 10/1987 | Muschner | 222/600 X |

FOREIGN PATENT DOCUMENTS

| | | | |
|---|---|---|---|
| 2060842 | 5/1981 | United Kingdom | 222/600 |

OTHER PUBLICATIONS

Russian Language Document "Modern Methods in the Operation of Cupola Furances", 1960, pp. 28–31, by A. A. Ananjin.

*Primary Examiner*—Joseph J. Rolla
*Assistant Examiner*—Nils E. Pedersen
*Attorney, Agent, or Firm*—Wenderoth, Lind & Ponack

[57] ABSTRACT

A worn and damaged refractory plate having a planar sealing surface with a sealing area at a first portion of the plate and a discharge opening extending through the plate at a second area is repaired or renewed by providing the damaged plate with a new discharge opening at the sealing area. The damaged, first-mentioned discharge opening and the wear area therearound are filled with refractory material to a level flush with the sealing surface, thereby forming a new sealing area.

5 Claims, 1 Drawing Sheet

METHOD OF REPAIRING OR RENEWING A WORN REFRACTORY PLATE OF A SLIDING CLOSURE UNIT

This is a continuation-in-part of application Ser. No. 893,447, now U.S. Pat. No. 4,702,460, filed Aug. 7, 1986, which is a continuation of application Ser. No. 678,033, filed Dec. 14, 1984, now abandoned.

BACKGROUND OF THE INVENTION

The present invention relates to a method for renewing or repairing a refractory plate employed as a stationary bottom plate or as an adjustably movable plate in a sliding closure unit for controlling the discharge of molten metal from a metallurgical vessel, the refractory plate having a planar sealing surface with a sealing area at a first portion of the plate and a discharge opening extending through the plate at a second area thereof, whereby during use of the sliding closure unit the plate becomes damaged and eroded in the discharge opening, and particularly at a wear area around the discharge opening at the sealing surface.

It is commonly known in the art to renew, maintain or repair such refractory plates which prematurely wear out at the discharge opening or openings as a result of the formation of cracks due to thermal stresses, corrosive and erosive attacks by the discharged stream of molten metal, as well as frictional forces between the stationary bottom plate and the adjustably movable plate, such renewal or repair lowering the cost of replacement of worn plates during operation. Thus, instead of new plates, there are employed repaired plates wherein, in principle, the wear area around the discharge opening has been leveled by machining, and the plate material thus lost is replaced with prefabricated inserts or with a filler material. Thus, West German Patent No. 32 43 305 proposes production steps according to which an eroded teeming hole is reamed coaxially almost to the peripheral edge of the plate, and the widened hole is filled with a refractory pourable material, while the flow section of the discharge opening is maintained or kept clear by employing, if necessary, a prefabricated ring which defines the discharge opening in the sliding surface of the plate. In this case, the corrective repair or maintenance is limited only to the discharge opening in the plate, and no attention is paid to the sealing surface of the plate.

SUMMARY OF THE INVENTION

Accordingly, the object of the present invention is to provide an improved method of renewing or repairing such refractory plates which is more efficient than previous methods and whereby the sealing surface of the plate also is repaired or renewed.

This object is achieved in accordance with the present invention by providing the damaged plate with a new discharge opening therethrough at the sealing area, and filling the damaged discharge opening and the wear area therearound with refractory material to a level flush with the sealing surface, thereby forming a new sealing area. That is, the eroded discharge opening is filled and sealed, and the wear area is built up to form a new sealing surface in the area previously employed for the discharge opening, whereas the area previously employed as a sealing area now is employed as a discharge area. In accordance with this method, the discharge opening as well as the sealing surface of the refractory plate equally are renewed. Furthermore, the process steps easily are implemented, and the useful life of the plate can be increased considerably, with both the discharge opening and the sealing surface substantially as good as new.

In accordance with one embodiment of the present invention, after the eroded or damaged discharge opening is cleaned, it is sealed off and filled with a prefabricated or previously prepared stopper which is fitted at least to a level coplanar with the plate sealing surface by employing refractory putty, mortar or the like, while the wear area around the stopper is joint-filled with such refractory putty, mortar or the like. In carrying out this embodiment of the present invention, the new discharge opening may be formed by drilling through the plate, thereby forming a drill core, and such drill core may be employed to fill the damaged discharge opening.

As an alternative to employing a stopper, a second embodiment of the present invention provides that the damaged discharge opening, after being cleaned, is filled up with a quick drying or quick setting pourable and settable refractory material. Such material is filled up to a level even or flush with the planar sealing surface of the plate. This embodiment of the present invention particularly is very simple and can be implemented with ease.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
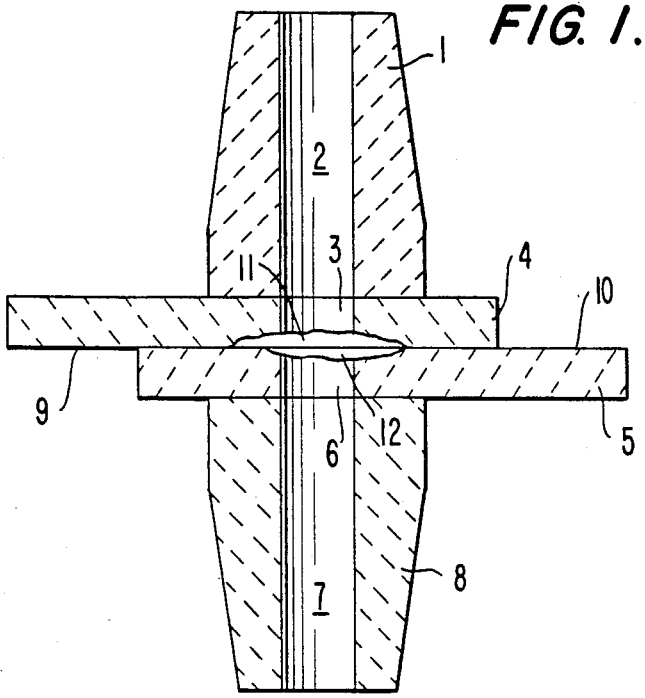
FIG. 1 is a schematic longitudinal sectional view through refractory wear parts of a linear sliding closure unit with eroded and damaged bottom and sliding refractory plates to be repaired in accordance with the present invention.

In FIG. 1 is illustrated the refractory parts of a linearly movable sliding closure unit including a refractory inlet sleeve 1 having therethrough an opening 2, a stationary bottom refractory plate 4 mounted with a discharge opening 3 thereof coaxial with opening 2 and having a lower planar sliding surface 9, an adjustably movable refractory plate 5 having therethrough a discharge opening 6 and an upper planar sliding surface 10, and a refractory outlet sleeve 8 mounted on plate 5 and having an outlet opening 7 coaxial with discharge opening 6. During use of the sliding closure unit the plate 5 is moved in opposite rectilinear directions to open, close or throttle a discharged stream of molten metal while sliding sealing surfaces 9, 10 are pressed together to form a seal. After a period of time of operation, wear areas 11, 12 develop around the edges of the discharge openings 3, 6 in the areas of sliding surfaces 9, 10, as is known in the art. When this occurs to a certain extent, the plates 4, 5 must be replaced. Such damaged plates that have been replaced and whose sealing surfaces still have sufficient operating efficiency are repaired or renewed, after visual inspection and thorough cleaning, for example by means of a power steel wire brush.

Figure 2:
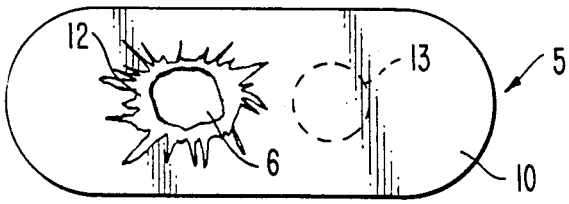
FIG. 2 is a plan view of the worn sliding plate illustrated in FIG. 1.
Figure 4:
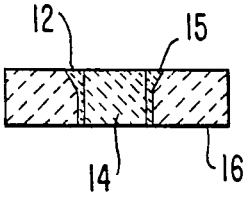
FIG. 4 is a transverse cross-sectional view of the plate shown in FIG. 3, in the area of the repair thereof.
Figure 3:
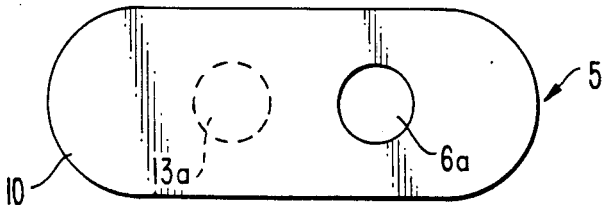
FIG. 3 is a similar plan view of the sliding plate after being repaired according to the present invention.

FIGS. 2 through 4 illustrate one embodiment of such renewal or repair of plate 5 in accordance with the present invention. It is to be understood that according to the present invention plate 4 similarly can be repaired.

Thus, during use of plate 5 an area 13 of the sealing surface 10 thereof acts as a sealing area. In accordance with the present invention this largely undamaged sealing area 13 of the damaged plate has formed therein a new discharge opening 6*a* . The old or damaged discharge opening 6 is filled or sealed with the thus obtained drill core operating as a stopper 14 and employing refractory mortar 15 or the like. The wear area 12 is joint-filled or smoothed out with the refractory mortar or the like to a level flush with sealing surface 10, thereby forming a new sealing area 13*a* to be employed during further use of the plate as a sealing area confronting discharge opening 3 in the closed position of the sliding closure unit. It will be understood that, as indicated above, stationary plate 4 can be repaired in a similar manner.

If the plates 4, 5 are intended to be inverted, i.e. if opposite surfaces thereof have completely planar surfaces intended to be equally employable as abutting sliding surfaces, then the second sliding surfaces, shown in FIG. 4 at 16, is also eroded before the above described repair or renewal operation becomes necessary. Instead of the drill core mentioned above, another prefabricated stopper prepared to have a snug fit can be inserted in the old, damaged discharge opening 6, and thereafter the wear area 12 is filled with refractory mortar 15 to the level of the appropriate sliding surface.

Figure 7:
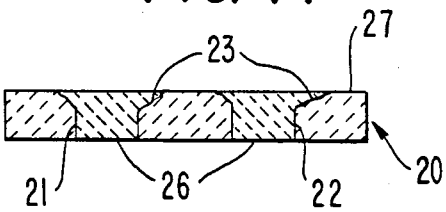
FIG. 7 is a cross-sectional view of the plate of FIG. 6, taken along the area of repair thereof.
Figure 5:
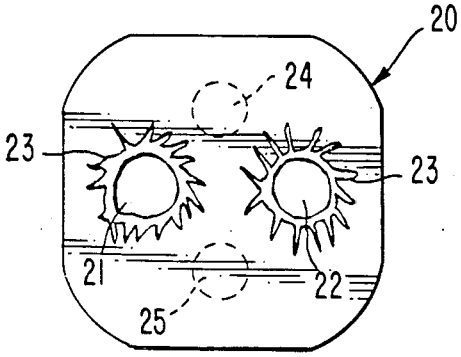
FIG. 5 is a plan view similar to FIG. 3, but of a refractory plate having plural discharge openings and employed in a rotary sliding closure unit.
Figure 6:
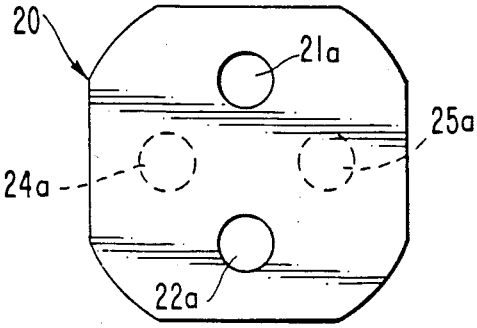
FIG. 6 is a plan view of the plate of FIG. 5, but after repair thereof in accordance with the present invention.

FIGS. 5–7 illustrate an alternative method according to the present invention. Thus, in this embodiment, rather than employing a stopper to fill the damaged discharge opening, after cleaning of the damaged discharge opening, filling thereof is achieved by use of a pourable and settable refractory material. Thus, FIGS. 5–7 illustrate an adjustably movable plate 20 having therethrough a pair of discharge openings 21, 22 and employable in a rotary sliding closure unit. Discharge openings 21, 22 are shown in FIG. 5 to be eroded and to have formed thereat wear areas 23. In accordance with the present invention, after drilling new discharge openings 21*a*, 22*a* in previously employed sealing areas 24, 25, the old, damaged discharge openings 21, 22 are filled with refractory material 26. Such filling is achieved up to a level flush and smooth with sliding surface 27 of plate 20. After setting of the refractory material 26, there thereby are formed new sealing areas 24*a*, 25*a*.

It is to be understood that plates 4, 5 of the embodiment of FIGS. 1 through 4 can be repaired by the embodiment illustrated in FIGS. 5–7, and that plate 20 illustrated in FIGS. 5–7 can be repaired by the method discussed above with regard to the embodiment of FIGS. 1–4.

In all cases in accordance with the present invention, the renewal or repair of the plates is sufficient to achieve continued dependable operation of the plates. Nevertheless, if desired the planar sealing surfaces of the renewed or repaired plates may be subjected to a grinding operation.

Although the present invention has been described and illustrated with respect to preferred features thereof, it is to be understood that various changes and modifications may be made to the specifically described and illustrated features without departing from the scope of the present invention.

I claim:

1. A method of renewing or repairing a refractory plate employed as a stationary bottom plate or as an adjustably movable plate in a sliding closure unit for controlling the discharge of molten metal from a metallurgical vessel, said refractory plate having a planar sealing surface with a sealing area at a first portion of said plate and a discharge opening extending through said plate at a second area thereof, whereby during use of the sliding closure unit said plate becomes damaged at a wear area around said discharge opening at said sealing surface, said method comprising:

providing forming in said damaged plate with a new discharge opening to extend through said plate at a desired location at said sealing area; and filling the damaged, first-mentioned discharge opening with refractory material to a level flush with said sealing surface, thereby forming a new sealing area.

2. A method as claimed in claim 1, wherein said filling comprises cleaning said damaged discharge opening and fitting thereinto a prepared stopper.

3. A method as claimed in claim 2, wherein said fitting comprises providing an end of said stopper coplanar with said sealing surface, and said filling further comprises filling said wear area around said stopper with a refractory putty, mortar or the like.

4. A method as claimed in claim 2, wherein said forming said new discharge opening comprises drilling said new discharge opening through said plate, thereby forming a drill core, and employing said drill core to fill said damaged discharge opening.

5. A method as claimed in claim 1, wherein said filling comprises cleaning said damaged discharge opening, and filling said damaged discharged opening and said wear area with pourable and settable refractory material.

* * * * *